United States Patent [19]

Sakaida et al.

[11] Patent Number: 4,653,943

[45] Date of Patent: Mar. 31, 1987

[54] PRINT HEAD

[75] Inventors: Atsuo Sakaida, Gifu; Ikuya Suzuki, Nishio, both of Japan

[73] Assignee: Brother Kogyo Kabushiki Kaisha, Japan

[21] Appl. No.: 715,875

[22] Filed: Mar. 25, 1985

[30] Foreign Application Priority Data

Mar. 27, 1984 [JP] Japan ..... 59-60253
Mar. 27, 1984 [JP] Japan ..... 59-44469[U]
Mar. 30, 1984 [JP] Japan ..... 59-47419[U]

[51] Int. Cl.[4] ..... B41J 3/12

[52] U.S. Cl. ..... 400/124; 101/93.05; 335/275

[58] Field of Search ..... 400/124; 101/93.05; 335/270, 275, 276, 279, 281

[56] References Cited

U.S. PATENT DOCUMENTS

| | | | |
|---|---|---|---|
| 4,051,941 | 10/1977 | Hebert | 400/124 |
| 4,165,940 | 8/1979 | Cacciola | 400/124 |
| 4,167,343 | 9/1979 | Golobay | 400/124 |
| 4,244,658 | 1/1981 | Mori | 101/93.05 X |
| 4,260,270 | 4/1981 | Cavallari | 101/93.05 X |
| 4,349,283 | 9/1982 | Sapitowicz | 400/124 |
| 4,367,962 | 1/1983 | Gaboardi | 400/124 |
| 4,382,701 | 5/1983 | Davenport | 400/124 |
| 4,447,166 | 5/1984 | Ochiai | 400/124 |
| 4,502,799 | 3/1985 | Weeks | 400/124 |
| 4,513,496 | 4/1985 | Wang | 101/93.05 X |
| 4,518,269 | 5/1985 | Akazawa | 400/124 |
| 4,552,064 | 11/1985 | Sanders | 101/93.05 X |

*Primary Examiner*—Paul T. Sewell
*Attorney, Agent, or Firm*—Jones, Tullar & Cooper

[57] ABSTRACT

Disclosed is a print head of a dot matrix printer in which an electromagnet assembly and a print wire assembly are mounted by means of a mounting assembly. The print wire assembly includes armature members radially arranged in a support base member which is provided at the rear end of a nose member for movably guiding print wires. These armature members face their corresponding electromagnetic cores of the electromagnet assembly with gaps therebetween, and are held in a rest position on the rear side by a backup member against the urging force of springs. In a mounted state, the backup member is positioned by a cap member of the mounting assembly. The posiiton of the backup member can be adjusted at the time of mounting, so that the gaps between the armature members and their corresponding electromagnetic cores are adjustable.

11 Claims, 10 Drawing Figures

PRINT HEAD

BACKGROUND OF THE INVENTION

The present invention relates to a print head of a dot matrix printer, and more specifically to a print head which comprises an electromagnet assembly, a number of elongated print wires, and a number of armature members, the electromagnet assembly including a number of electromagnetic core means.

In print heads of this type, an assembly including print wires and armature members is generally mounted on an electromagnet assembly by means of, for example, bolts or screws. Examples of such print heads are disclosed in U.S. Pat. Nos. 4,051,941, 4,165,940 and 4,382,701.

In such a conventional arrangement, however, maintaining assembly accuracy of essential parts is rather difficult and requires excessive labor, on account of variations in dimensional accuracy of components and errors in mounting the components. In particular, gaps between individual electromagnetic core means of the electromagnet assembly and their corresponding armature members are subject to variations, so that it is hard to obtain stable gap accuracy. With this arrangement, moreover, it is impossible to adjust the gaps. Therefore, impacts of magnetic forces applied to the individual print wires are subject to variations, lowering the print quality. Also, it is impossible to maintain uniform quality of print heads as industrial products.

Print heads are proposed which use leaf springs each provided with a number of legs or arms in place of the bolts or screws for mounting. These alternatives cannot, however, enjoy satisfactory mounting accuracy, leaving the aforesaid problems unsettled.

In the prior art arrangement, moreover, that portion of each armature member facing each corresponding electromagnetic core of the electromagnet assembly does not have an elaborate configuration, so that the degree of convergence of magnetic flux passing through the core is lowered with the advance toward the forward end of the corresponding portion of the armature member, resulting in lower magnetic flux density. Thus, in the case of a so-called attraction-type dot matrix printer in which print wires are driven by attracting armature members by excitation, it may be impossible to obtain a necessary attraction. In the case of a so-called release-type dot matrix printer in which print wires are driven by releasing armature members by deenergization, it may be impossible to obtain a necessary releasing force.

In general, the armature members are each formed of a platelike member which has two wider lateral faces and two narrower end edges. These armature members are disclosed in, for example, U.S. Pat. Nos. 4,051,941, 4,165,940 and 4,367,962. These armature members are radially arranged and their respective narrower end edges adjoin one another. Therefore, the angular intervals between the individual armature members are so wide that the number of arrangeable armature members is limited. Accordingly, the print wires used are reduced in number. Thus, it is difficult to increase the number of print dots and to miniaturize the print head. Particularly, the print heads of printers for Chinese characters, which require a relatively large number of print dots, would inevitably be increased in outside diameter.

In print heads of a type in which one end portion of each armature member and the rear end of its corresponding print wire are connected to each other, the rear end of the print wire conventionally is inserted into a fitting hole formed in the one end portion of the armature member, and is rigidly connected thereto by, e.g., brazing. According to this method, however, the connecting work is troublesome, and the joint portion is so wide that it is difficult to narrow the intervals between the radially arranged armature members. As a result, the number of arrangeable armature members cannot satisfactorily be increased. This constitutes a hindrance to the miniaturization of the print heads of the Chinese-character printers or the like which require a larger number of print dots.

SUMMARY OF THE INVENTION

The present invention was developed in consideration of these circumstances, and has as an object to provide a print head of a dot matrix printer in which armature members can readily be mounted on an electromagnet assembly so that gaps between the armature members and their corresponding electromagnetic cores are adjusted without variations, thereby making impacts of forces applied to the individual print wires uniform for improved print quality.

Another object of the invention is to provide a print head of a dot matrix printer in which the density of magnetic flux passing through each electromagnetic core is increased in the region where the electromagnetic core and its corresponding armature member face each other across a gap between them, thereby ensuring a satisfactory magnetic force.

Still another object of the invention is to provide a print head of small size furnished with an increased number of armature members without increasing its outside diameter, and adapted for use in, for example, a Chinese-character printer which requires a relatively large number of print dots.

According to the present invention, a backup member is provided for holding the armature members in their rest position. The position of the backup member is determined by a mounting assembly. The armature members and the backup member are mounted on an electromagnet assembly by attaching the mounting assembly to the electromagnet assembly. In doing this, the position of the backup member is adjusted by adjusting means attached to the mounting assembly. Thus, gaps defined between the armature members in the rest position and the magnetic core means opposed thereto are adjusted.

With the arrangement of the present invention described above, the armature members can be quickly mounted with ease on the electromagnet assembly, permitting adjustment of the gaps for uniformity. Thus, the gap accuracy is stabilized for higher print quality, and the print head as an industrial product is subject to less variations in accuracy.

According to a preferred specific arrangement, the adjusting means includes a U-shaped engaging portion formed on a mounting member of the mounting assembly, and a pair of engaging pieces with different widths extending toward each other from a pair of radial surfaces which face each other at the outer peripheral portion of a cap member of the mounting assembly to define a notch. The backup member is located in position by causing the U-shaped engaging portion selectively to engage one of the pair of engaging pieces at the time of assembly, thereby automatically adjusting the gaps.

Thus, the gap adjustment can be achieved together with the mounting of the mounting assembly without requiring any deliberate work after assemblying the print head thereby, enjoying improved efficiency.

In another preferred arrangement, a flange-shaped support base portion is formed integrally on the rear end of a nose member in which a number of print wires are slidably mounted. A number of armature members are mounted on the support base portion. Also, the support base portion is formed with through hole means facing the electromagnetic core means. The armature members face their corresponding electromagnetic core means through the through hole means.

In the arrangement described above, a number of armature members are simultaneously arranged on the support base portion, and are mounted together with the backup member on the electromagnet assembly by means of the mounting means. Thus, the assembly work, as a whole, is further improved in efficiency. Moreover, the nose member, the support base portion, all the armature members, and the backup member may be handled as a single unit, so that the assembly work can be accomplished speedily and easily without the possibility of the armature members falling.

In a further preferred arrangement, the armature members are each formed of a platelike member with a pair of wide lateral faces, and are radially arranged so that the lateral faces are opposed to those of their adjoining counterparts.

Accordingly, the armature members can be arranged at very narrow angular intervals, so that a greater number of armature members can be used in each print head without increasing the outside diameter of the print head. Thus, miniaturization of the print heads of those printers which require a larger number of print dots is facilitated.

In a further preferred arrangement, each armature member is formed at one end portion thereof with a pair of forked joint portions between which a fitting groove is defined. With the rear end of each corresponding print wire fitted in the fitting groove, the two forked joint portions are pressed on both sides to caulk the fitting groove, thereby fixedly connecting the wire end to the armature member.

Thus, in the connected state, the joint portions are tapered and narrow, so that the print wires may be arranged more closely to one another, further facilitating the miniaturization of the print head.

BRIEF DESCRIPTION OF THE DRAWINGS

These and other objects and advantages of the present invention will be more completely described below with reference to the accompanying drawings, in which.

DETAILED DESCRIPTION OF THE PREFERRED EMBODIMENT

Figure 1:
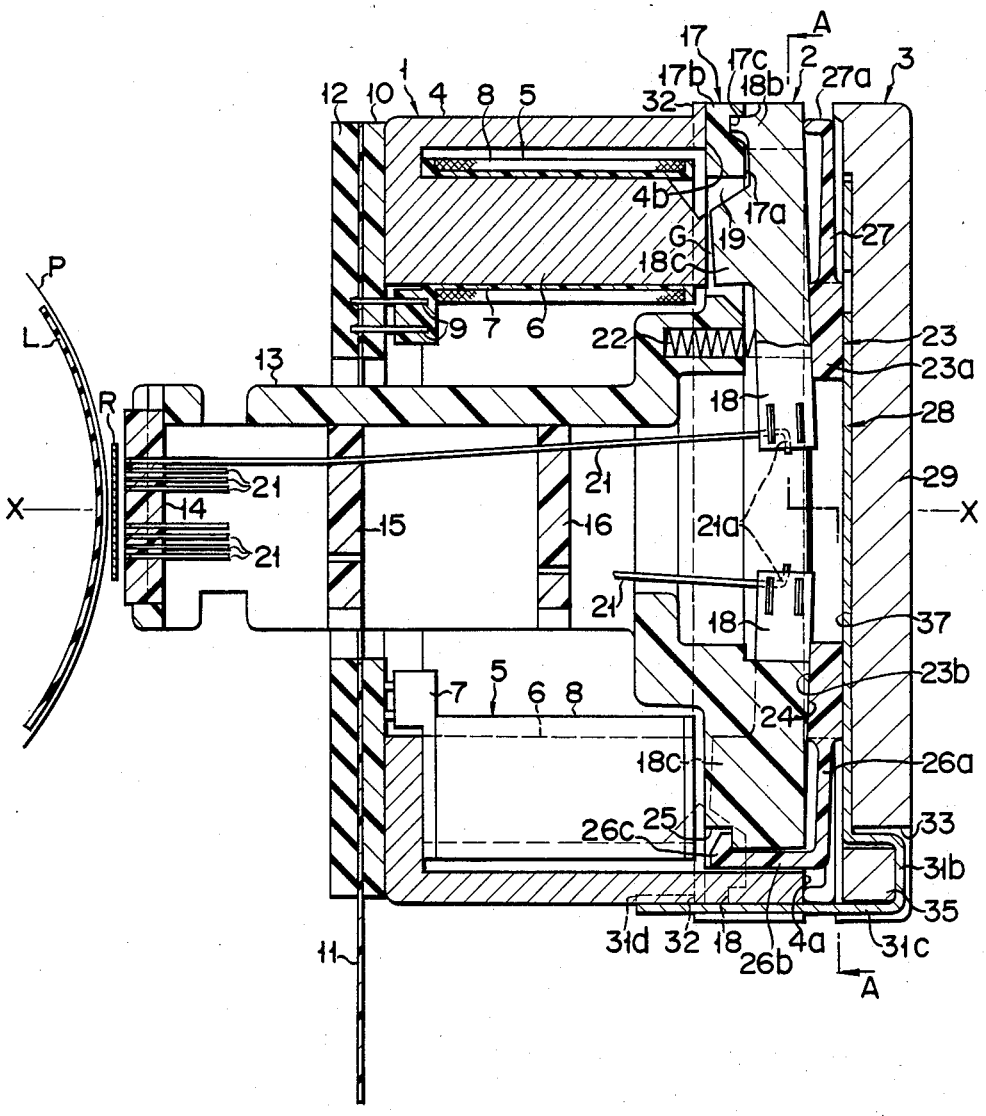
FIG. 1 is a vertical sectional view showing a mounted state of a print head according to a preferred embodiment of the present invention.
Figure 2:
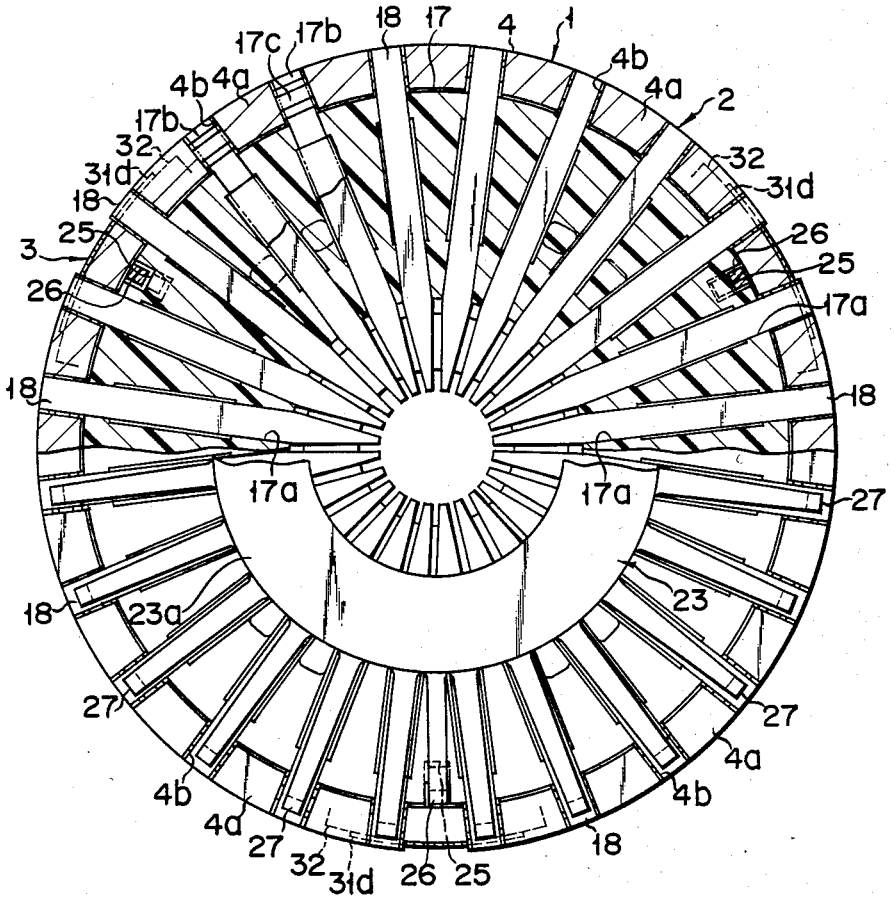
FIG. 2 is a front view, partially in section, taken along line A—A of FIG. 1.

As shown in FIG. 1, a print head of a dot matrix printer according to an embodiment of the present invention consists of three units, including an electromagnet assembly 1, a print wire assembly 2, and a mounting assembly 3 carrying the assemblies 1 and 2 together. The assemblies 1, 2 and 3 are concentrically arranged around a central axis X—X which extends along the longitudinal direction of the print head.

The print head, which is mounted on, for example, a carriage (not shown) on the printer, travels together with the carriage along a print line during a printing operation. Since the construction of the carriage is conventional, its description is omitted herein.

The print head and a platen L face each other across a sheet of recording paper P and a printing ribbon R. The facing side (left-hand side of FIG. 1) of the print head is defined as the front side, and the other side as the rear side.

The electromagnetic assembly 1 includes a substantially cylindrical yoke member 4 and a number of, for example 24, electromagnetic structures 5 which are arranged in a circle.

Figure 3:
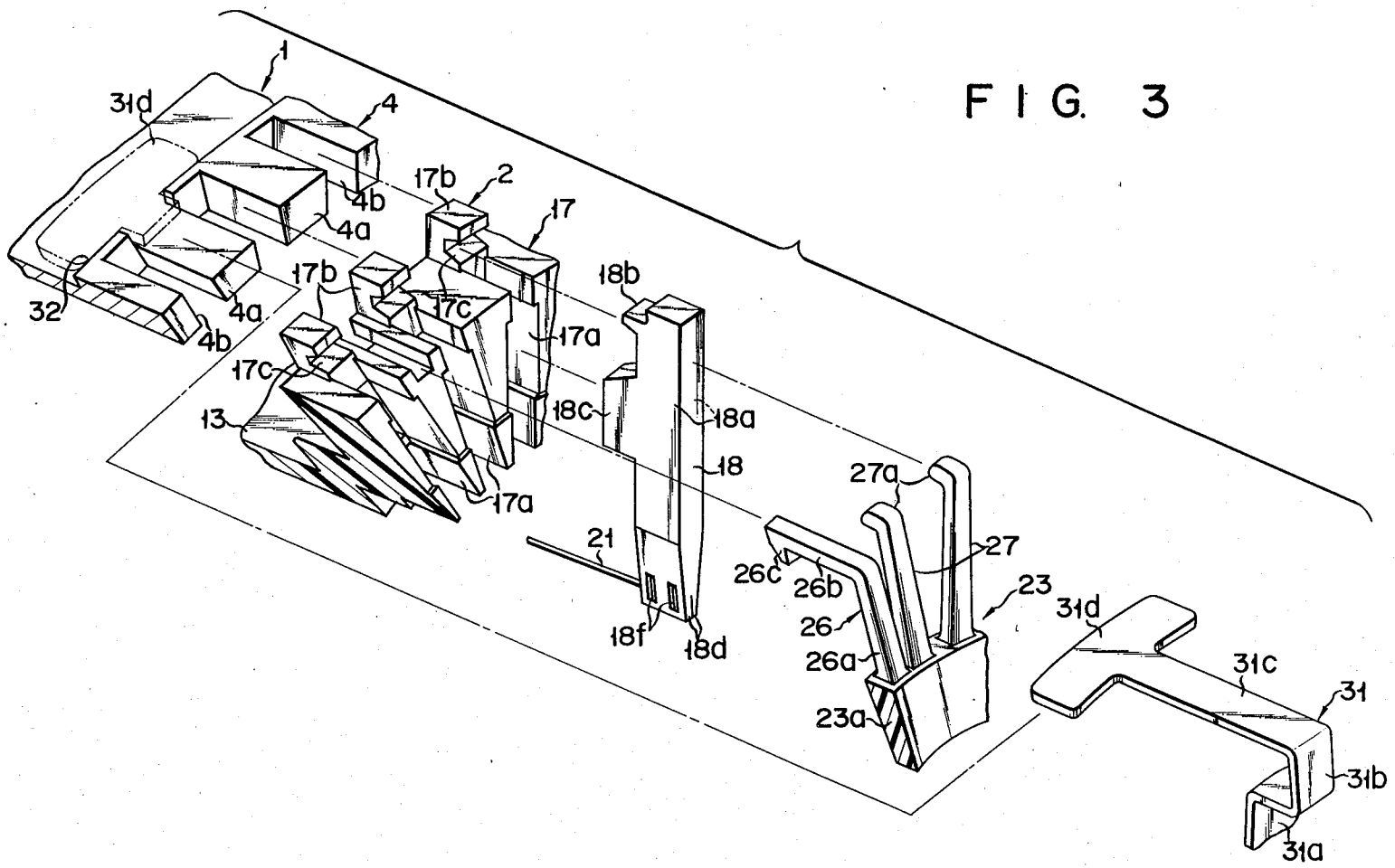
FIG. 3 is an exploded perspective view showing the principal part of the print head of FIG. 1.

As best seen from FIG. 3, axial slits 4*b* are formed in the outer peripheral portion of the rear end of the yoke member 4 with radial end faces 4*a* left between them so that the outer peripheral portion is comb-shaped. Each slit 4*b* is defined by a pair of partition walls arranged radially.

Each electromagnetic structure 5 is formed of an electromagnetic core 6 constituting electromagnetic core means together with the yoke member 4 and a coil 8 wound on a bobbin 7 which is fitted on the core 6. The two ends of the coil 8 are connected individually to a pair of connector pins 9 which protrude from the bobbin 7. A printed board 11 with an insulating plate 10 is fixed to the front side of the yoke member 4. The connector pins 9 penetrate the printed board 11 and are soldered thereto to be coupled to an external control unit (not shown) through the printed board 11. The front face of the printed board 11 is covered with a protective rubber sheet 12.

The print wire assembly 2 includes a nose member 13 which extends along the axis X—X, surrounded by the electromagnetic assembly 1. A number of, for example 24, print wires 21 are mounted in the nose member 13 so as to be movable along the axis X—X. The wires 21 are guided by wire guides 14, 15 and 16 which are arranged at intervals inside the nose member 13. The respective front ends of the print wires 21 are supported by the foremost wire guide 14, facing the platen L so as to be able to advance toward or retract from the same. Thus, impressions of desired characters or other symbols are printed on the recording paper P which is placed between the platen L and the printing ribbon R.

The rear end of the nose member 13 is formed integrally with a support base member 17 which radially extends to form a flange or disk on the nose member 13. These two members 17 and 13 are formed from, e.g., synthetic resin which can be elastically deformed to some degree by a compressive force. Alternatively, however, only the support base member 17 may be formed from an elastic material. In this case, the members 17 and 13 are coupled together.

As expressly shown in FIG. 3, a number of, for example 24, guide grooves 17*a* are formed in the radial rear face of the support base member 17, radially arranged around the axis X—X. Also, teeth 17*b* radially protrude from the outer peripheral edge of the member 17 in which the guide grooves 17*a* are formed. In assembling, the teeth 17*b* are fitted tight in their corresponding slits 4*b* of the yoke member 4 so that the support base member 17 is prevented from rotating relatively to the yoke member 4. As seen from FIG. 1, the left or front end face of each tooth 17*b* abuts against the bottom surface of its corresponding slit 4*b*.

The rear face of each tooth 17*b* is formed with a supporting recess 17*c* which constitutes part of supporting means for armature members 18 (described in detail later).

The armature members 18 are guided and housed individually in the guide grooves 17*a* of the support base member 17. Thus, the armature members 18 are radially arranged on the support base member 17. Each armature member 18 is in the form of a platelike member having two wide lateral faces 18*a*. The lateral faces 18*a* of each armature member 18 faces the wall surfaces of each corresponding guide groove 17*a* when the armature member 18 is fitted in the guide slit 17*a*. Thus, in the arranged state, the lateral faces 18*a* of each two adjacent armature members 18 face one another. In other words, the lateral faces 18*a* of the armature members 18 are parallel to a plane which contains the axis X—X. The outermost end portion of each armature member 18 is fitted in its corresponding slit 4*b* of the yoke member 4, forming a magnetic path between a pair of partition walls which define the slit 4*b*.

Each armature member 18 includes a lug 18*b* integrally protruding outward from its left-hand (FIG. 1) or front edge at the radially outer end portion or proximal end portion, and an integral extended portion 18*c* in the substantially middle portion. The extended portion 18*c* and the core 6 of each corresponding electromagnetic structure 5 face each other across corresponding through holes 19 formed in the support base member 17, leaving an air gap G between them. The extended portion 18*c* is tapered toward the core 6. That end portion of the core 6 facing the extended portion 18*c* is also tapered.

With the tapered configuration of the extended portion 18*c*, in particular, magnetic flux delivered from the core 6 of each electromagnetic structure 5 and passing through the outer peripheral portion of the yoke member 4 and the proximal end portion and the extended portion 18*c* of each corresponding armature member 18 to reach the core 6 converges to a higher degree with the advance toward the extreme end of the extended portion 18*c*, resulting in an increase in magnetic flux density. Thus, the electromagnetic structure 5 can apply a greater magnetic force to the armature member 18.

The lug 18*b* is a supporting portion which engages the supporting recess 17*c*, constituting a supporting point for the swing of the armature member 18 in conjunction with the supporting recess 17*c*. In contrast with this, a supporting recess and a lug may be provided on the sides of the armature member 18 and the support base member 17, respectively.

The radially inward end or free end of each armature member 18 is fixedly connected to the rear end of its corresponding print wire 21. In a connected state, the print wire 21 extends at substantially right angles to the armature member 18 and within a plane parallel to the plane of the lateral faces 18*a* of the member 18.

Figure 4:
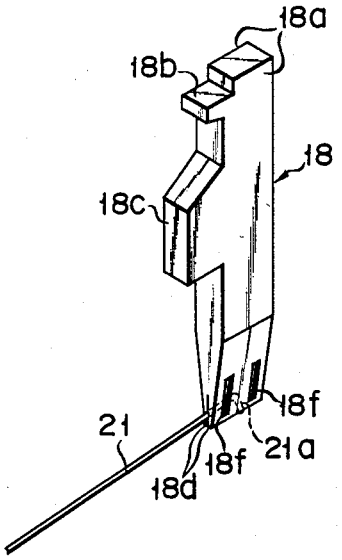
FIG. 4 is a perspective view showing a connection between an armature member and a print wire.
Figure 5:
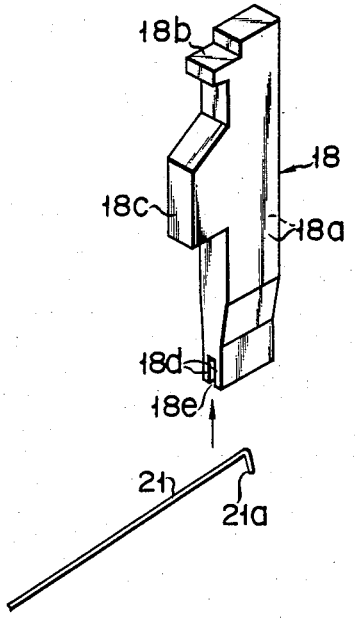
FIG. 5 is a perspective view corresponding to FIG. 4 showing a state before connection.

Referring now to FIGS. 4 and 5, the mode of connection between each armature member 18 and its corresponding print wire 21 will be described.

As shown in FIG. 5 illustrating the state before connection, the platelike armature member 18 is integrally provided at one end or free end portion thereof with a pair of forked joint pieces 18*d* which are formed parallel to the lateral faces 18*a* by machining, facing each other to define a fitting groove 18*e* between them. Thus, the groove 18*e* extends parallel to the lateral faces 18*a* and is opened at the front, rear and bottom sides.

An L-shaped bent portion 21*a* is formed at the rear end of the print wire 21. The rear end of the print wire 21, along with the bent portion 21*a*, is fitted in the fitting groove 18*e*. Then, the forked joint pieces 18*d* are pressed from both sides to caulk the groove 18*e*. As a result, the print wire 21 is fixedly connected to the armature member 18, as shown in FIG. 4. The bent portion 21*a* serves to prevent the print wire 21 from rotating relatively to the armature member 18, thereby ensuring a more stable connection.

During the aforesaid caulking work, a pair of pressed recesses 18*f* are formed on the outer lateral faces of each joint piece 18*d*. The pair of recesses 18*f* are positioned on either side of the bent portion 21*a*. Thus, the print wire 21 is securely held and prevented not only from dropping downwardly but from slipping off in its longitudinal direction. As shown in FIG. 4, moreover, the lateral faces of the two forked joint pieces 18*d* after caulking are tapered toward the bottom edge. Therefore, the thickness of the coupled portion is further reduced, so that the individual armature members 18 can be joined closer to one another in their radial arrangement, permitting a more dense and compact arrangement of the print wires 21, thus facilitating miniaturization of the print head.

A compression coil spring 22 constituting urging means is provided at the bottom portion of each guide groove 17*a* of the support base member 17. The spring 22 normally urges its corresponding armature member 18 to the right of FIG. 1. Thus, the spring 22 acts in a direction such that the print wire 21 is pulled to the right to have its tip end retracted.

When one of the electromagnetic structures 5 is excited, its corresponding armature member 18 rocks to the left of FIG. 1 against the urging force of the spring 22, thereby driving its corresponding print wire 21 to project toward the platen L. Thus, the armature member 18 moves from a rest position shown in FIG. 1 to a drive position when excited, and is returned in the opposite direction by the urging force of the spring 22 when deenergized.

A backup member 23 made of synthetic resin is disposed on the rear side of the armature members 18 opposite to the support base member 17. The backup member 23 has a ring-shaped central hub 23*a*. A radial front face 23*b* of the central hub 23*a* abuts against all the radially arranged armature members 18, thereby defining the rest position of the armature member 18. The central hub 23*a* also abuts against a radial rear face 24 of the support base member 17, as shown in FIG. 1.

Three retaining arm members 26 integrally extend in the radial direction from the central hub 23*a*, arranged at angular intervals of 120 degrees. Each arm member 26 is formed of a first resilient arm 26*a* extending radially outwardly, a second resilient arm 26*b* axially extending from the free end of the arm 26*a*, and a hook 26*c* at the free end of the arm 26*b*. The arm member 26 can bend like a leaf spring. Corresponding to the respective hooks 26*c* of the three arm members 26, engaging recesses 25 are formed in the outer peripheral portion of the support base member 17. The hooks 26*c* are adapted to releasably engage their corresponding engaging recesses 25, as shown in FIG. 1. The arm members 26 and the engaging recesses 25 constitute fastening means, whereby all the armature members 18 are locked to the print wire assembly 2 to form a unit. Thus, in mounting the print wire assembly 2 on the electromagnet assembly 1, the combination of the armature members 18 and the print wire assembly 2 can be handled as a single unit for ease in mounting. Instead of using the recesses 25, shoulder portions capable of engaging the hooks 26*c* may be formed on the support base member 17.

The backup member 23 is further provided with a plurality of for example 24, resilient fingers 27 which integrally extend radially outward from the central hub 23*a*. These fingers 27 correspond individually to the armature members 18, having their bent end portions 27*a* elastically abutting against the outer end portions of their corresponding armature members 18 on the rear side thereof opposite to the lugs 18*b*. Thus, the lug 18*b* of each armature member 18 is kept in engagement with its corresponding supporting recess 17*c*.

The mounting assembly 3 will now be described in detail.

Figure 6:
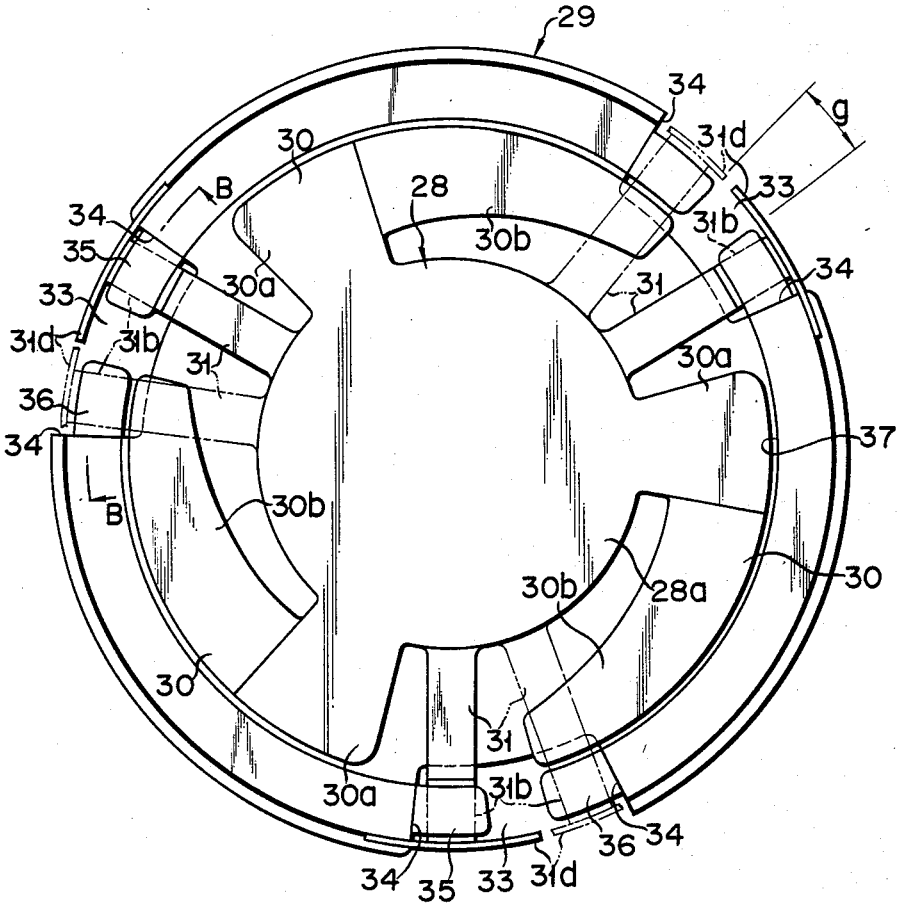
FIG. 6 is a front view showing a cap member and a mounting member mounted on each other.

As shown in FIG. 6, the mounting assembly 3 includes a mounting member 28 generally formed from a leaf spring material and a cap member 29 circular in shape and made of metal. The mounting member 28 is formed of a central planar portion 28*a*, and three spring arms 30 and three resilient fixing arms 31 integrally extending from the planar portion 28*a*.

Each spring arm 30 is formed of a first arm portion 30*a* extending radially and a second arm portion 30*b* circumferentially extending from the first arm portion 30*a* and gently declined toward the cap member 29.

Each resilient fixing arm 31 is formed of a first arm portion 31*a* extending radially, a substantially U-shaped engaging portion 31*b*, a second arm portion 31*c* extending axially, and a T-shaped engaging lug portion 31*d* at the free end of the second arm portion 31*c*. As shown in FIGS. 1 and 3, each engaging lug portion 31*d* releasably engages its corresponding one of engaging step portions 32 formed on the outer periphery of the yoke member 4 of the electromagnet assembly 1. The resilient fixing arms 31 and the engaging step portions 32 constitute fixing means for releasably fixing the cap member 29 to the electromagnet assembly 1.

Figure 7:
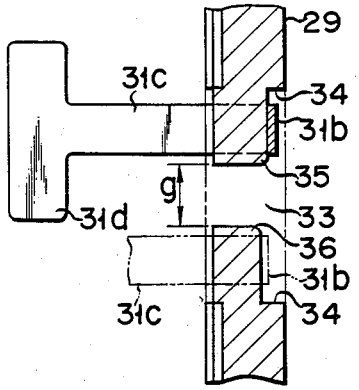
FIG. 7 is a cutaway partial view of a principal part taken along line B—B of FIG. 6.

In FIGS. 6 and 7, three notches 33 are formed in the outer peripheral portion of the cap member 29, arranged at angular intervals of 120 degrees. Each notch 33 is defined by a pair of radial surfaces 34 facing each other. Engaging pieces 35 and 36 with a rectangular cross-section circumferentially extend individually from the two facing radial surfaces 34 toward each other, leaving a gap g between them. The gap g is a little wider than the width of the U-shaped engaging portion 31*b*. The pair of engaging pieces 35 and 36 and the U-shaped engaging portion 31*b* constitute adjusting means.

As shown in FIG. 7, the respective right-hand side faces of the engaging pieces 35 and 36 on the rear side of the cap member 29 are different in axial level along the axis X—X. More specifically, the axial width of the one engaging piece 35 is greater than that of the other engaging piece 36. In other words, the rear face of the one engaging piece 35 is located behind that of the other engaging piece 36.

As a modified example to replace the arrangement of the pair of engaging pieces 35 and 36, a single engaging piece may be provided which extends from one radial surface 34 toward the other radial surface 34 so that the gap g is left between the end face of the engaging piece and the other radial surface 34, and whose rear face is tapered along its longitudinal direction so that the width of the engaging piece varies gradually.

As shown in FIGS. 6 and 7, the U-shaped engaging portions 31*b* of the mounting member 28 can be caused selectively to engage the engaging pieces 35 indicated by full lines or the other engaging pieces 36 indicated by chain lines by slightly rotating the mounting member 28 relatively to the cap member 29 through the gap g between the corresponding pair of engaging pieces 35 and 36.

In the case of the aforesaid modification, the U-shaped engaging portion can be caused to engage any portion of the single engaging piece.

When the U-shaped engaging portions 31*b* are in engagement with the narrower engaging pieces 36, the second arm portions 31*c* of the fixing arms 31 extend a longer distance from the cap member 29 than in the case where the U-shaped engaging portions 31*b* are in engagement with the wider engaging pieces 35. In the former case, therefore, the engaging lugs 31*d* are axially located farther from the cap member 29.

Figure 8:
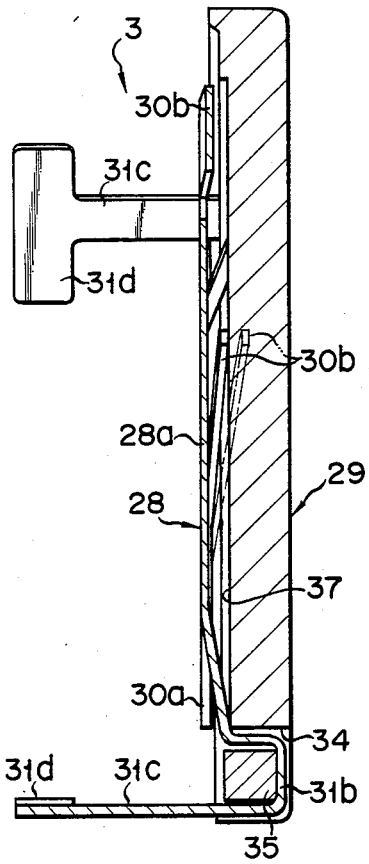
FIG. 8 is a vertical sectional view showing the cap member and the mounting member mounted on each other.
Figure 9:
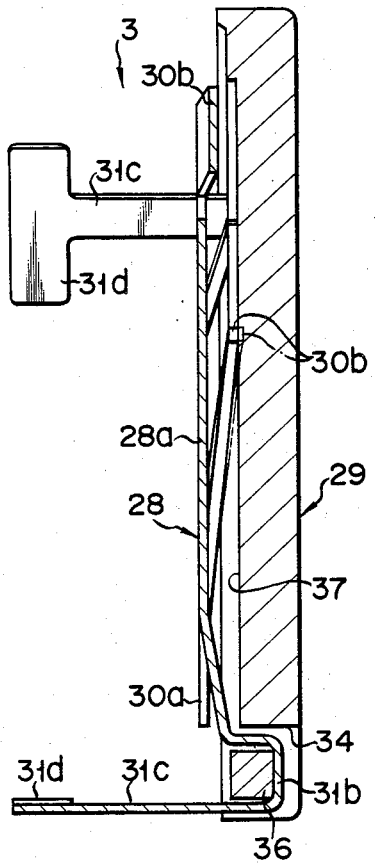
FIG. 9 is a vertical sectional view corresponding to FIG. 8 showing a different mode of mounting.

Thus, the cap member 29 and the mounting member 28 are combined together by engaging the U-shaped engaging portions 31*b* with their corresponding engaging pieces 35 or 36. FIG. 8 shows a state in which the engaging portions 31*b* are mounted on the wider engaging pieces 35, while FIG. 9 shows a state in which the engaging portions 31*b* are mounted on the narrower engaging pieces 36. In FIGS. 8 and 9, chain lines indicate the position of the second arm portion 30*b* of the spring arm 30 in a free state. After the mounting, the second arm portion 30*b* elastically abuts against the wall surface of a mounting member holding recess 37 which is formed in the left-hand or front side of the cap member 29. By this spring action, the mounting member 28 and the cap member 29 are kept combined with each other without loosening. In the states of FIGS. 8 and 9 in which the mounting assembly 3 is not mounted on the electromagnetic assembly 1, the mounting member 28 is kept somewhat apart from the recess 37 of the cap member 29 by its own spring action.

When the print wire assembly 2 is mounted on the electromagnet assembly 1 by means of the mounting assembly 3, as shown in FIG. 1 (in which the U-shaped engaging portions 31*b* are in engagement with the wider engaging pieces 35), the cap member 29 presses the rear side of the backup member 23 through the medium of the mounting member 28, thereby determining the axial position of the member 23, especially that of the central hub 23*a*.

Thus, the position of the front face 23*b* of the backup member 23 is fixed, and the rest positions of all the armature members 18 are defined. As a result, the gaps G between the armature members 18 and their corresponding cores 6 are uniformly adjusted to a desired width.

When the central hub 23*a* of the backup member 23 is urged to the left of FIG. 1 by the cap member 29, the front face 23*b* of the hub 23*a*, which is in contact with the radial rear face 24 of the support base member 17, presses the face 24 to the left, thereby elastically deforming the member 17 to some degree. The support base member 17 is formed from an elastically deformable material, such as synthetic resin. Thus, in the mounted state, the support base member 17, backup member 23, mounting member 28, and cap member 29 are elastically in contact with one another, so that the play or looseness of these members may be absorbed, ensuring high dimensional accuracy of the gap G. Also, the space for the rocking action of the armature members 18 is kept substantially constant even though the rest position of the armature members 18 is changed by the central hub 23*a* of the backup member 23.

In the mounted state shown in FIG. 1, the U-shaped engaging portions 31*b* are in engagement with the wider engaging pieces 35, so that the cap member 29 is located in its leftward position where it is closer to the assemblies 1 and 2. Accordingly, the urging force acting on the backup member 23 is great, causing the central hub 23*a* to take its leftward position. As a result, the gap G becomes narrower, and the support base member 17 is deformed substantially.

Figure 10:
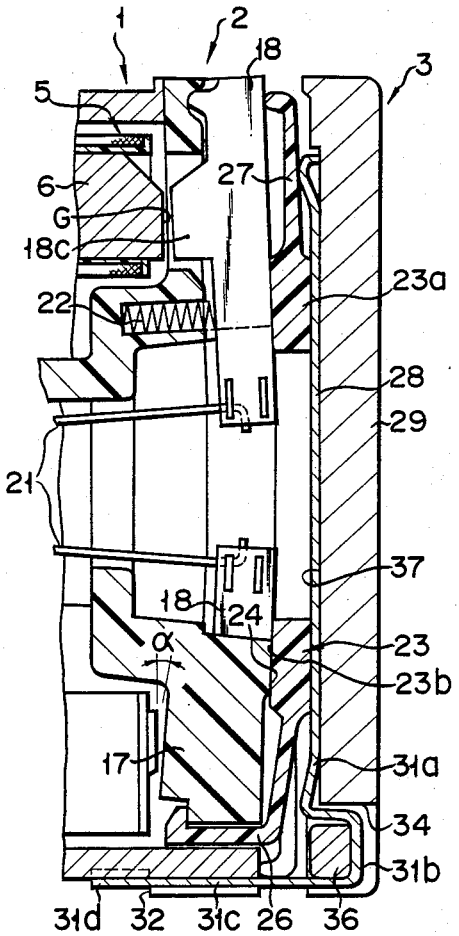
FIG. 10 is a vertical sectional view of a principal part showing a mode of gap adjustment different from the mode of FIG. 1.

FIG. 10 shows a mounted state in which the U-shaped engaging portions 31*b* are in engagement with the narrower engaging pieces 36. In this case, the second arm portions 31*c* extend a longer distance from the cap member 29, and the cap member 29 is located farther from the assemblies 1 and 2 than in the case FIG. 1. Accordingly, the urging force acting on the backup member 23 is smaller, so that the central hub 23*a* is located in a rearward position. Thus, the gap G becomes wider.

In this case, as seen from FIG. 10, the first arm portion 31*a* of the mounting member 28 is apart from the bottom surface of the recess 37 of the cap member 29, although the central portion of the member 28 is in contact with the recess 37. This situation is caused because, in the mounted state, the backup member 23 is urged to press the mounting member 28 rearward by the force of the support base member 17 to cause elastic deformation. In this case, the mounting member 28 may possibly be kept somewhat apart from the recess 37, depending on the balance between its own spring force and the force excerted thereon.

In FIG. 10, as the position of the backup member 23 retreats, the support base member 17 is elastically restored toward its original position through an angle $\alpha$ from the position shown in FIG. 1. As a result, the radial face 24 is greatly curved rearward to be elastically in contact with the front face 23*b* of the central hub 23*a*. Nevertheless, the outer peripheral portion of the support base member 17 is always in contact with the yoke member 4.

In a free state before mounting, the radial face 24 of the support base member 17 is curved to a degree such that it rearwardly projects by a greater margin than in the state of FIG. 10. The deformation of the support base member 17, however, has little influence on the shape of the nose member 13.

Although an illustrative embodiment of the present invention has been described in detail herein, it is to be understood that the invention is not limited to that precise embodiment. Instead of using the two-stage gap adjustment system, for example, three or more stages may be provided for the adjustment. Alternatively, the gap may be varied continuously without departing from the scope or spirit of the invention.

In the embodiment described above, the backup member 23 is locked to the support base member 17 by means of the retaining arm members 26. Alternatively, in mounting the mounting assembly 3 on the electromagnet assembly 1, the backup member 23 having no retaining means like the retaining arm member 26 may be interposed between the two assemblies 3 and 1 without being allowed to rotate relatively to them.

It is to be understood that the present invention is not limited to the above embodiment, and that various changes and modifications may be effected therein by one skilled in the art without departing from the scope or spirit of the invention.

What is claimed is:

1. A print head of a dot matrix printer adapted to provide an impression against a platen, comprising:

an electromagnet assembly including a number of electromagnetic core means;

a number of elongated print wires;

a nose member for slidably mounting the print wires, said nose member having a forward end from which the forward end of said print wire can project toward the platen;

a number of armature members facing individually the electromagnetic core means and movable between an drive position and a rest position, each said armature member and its corresponding electromagnetic core means defining a gap therebetween;

biasing means for urging the armature members toward the rest position;

connecting means for operatively connecting the armature members with the rear ends of their corresponding print wires;

a backup member for holding the armature members in the rest position against the urging force of the biasing means; and a mounting assembly including a cap member for locating the backup member in a predetermined position when the backup member is mounted on the electromagnet assembly, said cap member having a plurality of first engaging portions which are different in width, and fixing means for fixing the cap member to the electromagnet assembly, said fixing means having a second engaging portion which is able to selectively engage said first engaging portions thereby adjusting the gap between each said armature member in the rest position and the magnetic core means opposed thereto.

2. The print head according the claim 1, wherein said cap member is circular in shape and has a notch in the outer peripheral portion thereof defined by a pair of radial surfaces spaced and facing each other and said first engaging portions are a pair of engaging pieces integrally circumferentially protruding from the individual radial surfaces of the cap member and, wherein said fixing means includes a mounting member disposed between the cap member and the backup member, said second engaging portion being formed on the mounting member and having a U-shape.

3. The print head according to claim 2, wherein said mounting member is formed of a leaf spring material and includes a circular central planar portion and a spring arm extending therefrom and elastically in contact with the cap member, said spring arm being provided with said second engaging portion.

4. A print head of a dot matrix printer adapted to provide an impression against a platen, comprising:

an electromagnetic assembly including a number of electromagnetic core means;

a number of elongated print wires;

a nose member for slidably mounting the print wires, said nose member having a forward end from which the forward end of each said print wire can project toward the platen;

a cylindrical support base member;

a number of armature members radially mounted on the support base member and movable between a drive position and a rest position, each said armature member including a portion defining a gap with the electromagnetic core means corresponding to the armature member;

biasing means for urging the armature members toward the rest position;

connecting means for operatively connecting the armature members with rear ends of their corresponding print wire;

a backup member for holding the armature members in the rest position against the urging force of the biasing means;

mounting means for mounting the backup member and the support base member on the electromagnetic assembly, each said armature member being in the form of a platelike member having a pair of end edges and a pair of lateral faces which are larger in width than said end edges, said armature members being radially arranged at intervals so that the lateral faces of the adjacent armature members face one another, said support base member including a number of radial guide grooves adapted to movably guide and receive the armature members individually; and first supporting portions corresponding individually to the armature members, whereby the armature members are rocked between the drive position and the rest position thereof, said armature members including corresponding second supporting portions constituting supporting points for rocking in conjunction with their corresponding first supporting portions of the support base member, one of said first and second supporting portions being formed of a lug and the other being formed of a recess which engages the lug.

5. The print head according to claim 4, wherein each said first supporting portion is the recess, and each said corresponding second supporting portion is the lug.

6. The print head according to claim 4, wherein said electromagnet assembly includes a cylindrical yoke member having an end edge with a number of circumferentially arranged slits each defined by a pair of radial partition walls, and said support base member is formed at the outer peripheral portion thereof with a number of teeth spaced circumferentially so as to be fitted individually in the slits of the yoke member.

7. The print head according to claim 6, wherein each said armature member has a portion adapted to be inserted into its corresponding slit of the yoke member of the electromagnet assembly when the teeth of the support base member are fitted in the slits, and a magnetic path is formed between the two lateral faces of each said armature member and the partition walls defining its corresponding slit.

8. A print head of a dot matrix printer adapted to provide an impression against a platen, comprising:

an electromagnet assembly including a number of electromagnetic core means;

a number of elongated print wires;

a nosemember for slidably mounting the print wires, said nose member having a forward end from which the forward end of each said print wire can project toward the platen;

a support base portion in the form of a flange provided integrally on the rear end of the nose member, said support base potion including through holes means facing the electromagnetic core means;

a number of armature members mounted on the support base portion and movable between a drive position and a rest position, each said armature including a portion facing the electromagnetic core means across the through hole means;

biasing means for urging the armature members toward the rest portion;

connecting means for operatively connecting the armature member at one end thereof with the rear end of each corresponding print wire;

a backup member for holding the armature members in the rest position against the urging force of the biasing means; and mounting means for mounting the backup member and the support base portion on the electromagnet assembly, wherein said backup member includes a central hub adapted to abut against the armature members when the armature members are in the rest position, a number of resilient fingers integrally extending in the radial direction from the central hub, said resilient fingers corresponding individually to the aramture members so that the free end of each said resilient finger engages the other end of each corresponding armature member, a plurality of first resilient arms radially extending from the central hub, second resilient arms axially extending from the free ends of the first resilient arms, and hooks formed on the free ends of the second resilient arms, which releaseably engage a plurality of engaging recess formed in the support base portion corresponding to the hooks.

9. A print head of a dot matrix adapted to provide an impression againt a platen, comprising:

an electromagnet assembly having a cylindrical periphery and including a number of electromagnetic core means which are arranged radially around a longitudinal axis thereof and define a central bore having first and second openings at respective first and second side ends of the electromagnet assembly along the longitudinal axis;

a number of elongated print wires having forward and rear ends, respectively;

a nose member for slidably mounting the print wires, said nose member being inserted into said central bore and having a forward end extending through said first opening and a rear end extending through said second opening, said forward end of each print wire being able to project toward the platen through said forward end of the nose member;

a support base portion is the form of a flange provided integrally on the rear end of the nose member, said support base portion being positioned to abut against said second side end of the electromagnet assembly and including through holes means facing the electromagnetic core means;

a number of aramture members mounted on the support base portion and movable between a drive position and a rest position, each said armature member having first and second ends and including a portion facing the electromagnetic core means across the through hole means;

biasing means for urging the armature members toward the rest portion;

connecting means for operatively connecting the armature member at the first end thereof with the rear end of each corresponding print wire;

a backup member for holding the armature member in the rest position against the urging force of the biasing means; and mounting means for mounting the backup member and the support base portion on the electromagnetic assembly so that the forward end of the nose member projects toward the platen.

10. The print head according to claim 9, wherein said support base portion has a number of radial guide grooves adapted to movably guide and receive the respective armature members.

11. The print head according to claim 9, wherein said electromagnet assembly is provided along the cylindrical periphery thereof with a number of circumferentially arranged slits each defined by a pair of radial partition walls, and wherein said second end of the armature member is located in said corresponding slit so that a magnetic path is formed between the radial partition walls and two lateral faces of the armature member.

* * * * *

UNITED STATES PATENT AND TRADEMARK OFFICE

CERTIFICATE OF CORRECTION

PATENT NO. : 4,653,943

DATED : March 31, 1987

INVENTOR(S) : Atsuo Sakaida and Ikuya Suzuki

It is certified that error appears in the above-identified patent and that said Letters Patent is hereby corrected as shown below:

Claim 1, column 10, line 38, "an" should be --a--.
Claim 2, column 10, line 62, "the"(second occurrence) should be --to--.
Claim 8, column 12, line 16, "nosemember" should be --nose member--;
line 22, "potion" should be --portion--;
line 23, "holes" should be --hole--; and
line 56, "recess" should be --recesses--.

Signed and Sealed this

Twenty-sixth Day of April, 1988

*Attest:*

DONALD J. QUIGG

*Attesting Officer*

*Commissioner of Patents and Trademarks*